United States Patent [19]

Clapp

[11] 4,103,306

[45] Jul. 25, 1978

[54] NON-IMPACT PRINTER WITH MAGNETIC INK REORIENTATION

[75] Inventor: Roger E. Clapp, Cambridge, Mass.

[73] Assignee: Epp Corp., Boston, Mass.

[21] Appl. No.: 710,281

[22] Filed: Jul. 30, 1976

[51] Int. Cl.[2] ..... G03G 19/00; G03G 15/06

[52] U.S. Cl. ..... 346/153; 346/150

[58] Field of Search ..... 346/150, 153, 155, 74.1

[56] References Cited

U.S. PATENT DOCUMENTS

| | | | |
|---|---|---|---|
| 3,257,222 | 6/1966 | Carlson | 346/153 |
| 3,419,884 | 12/1968 | Betts | 346/153 |
| 3,530,794 | 9/1970 | Ritzerfield | 346/153 |
| 3,816,840 | 6/1974 | Kotz | 346/153 |
| 3,879,737 | 4/1975 | Lunde | 346/153 |
| 3,929,098 | 12/1975 | Liebman | 346/153 |

*Primary Examiner*—Jay P. Lucas

*Attorney, Agent, or Firm*—Kenway & Jenney

[57] ABSTRACT

A non-impact printer having a support for magnetic ink particles loosely distributed on its surface in mutually spaced aggregates of irregular height. An electrical field of short duration, established in a print position between the particles and a shaped print electrode, charges the particles and attracts them to an intervening recipient sheet. The printed image is rendered more uniform by magnetic reorientation of the aggregates of greater height before printing, in a field having components normal to the electrical field in the region of the print position.

17 Claims, 6 Drawing Figures

FIG. 1
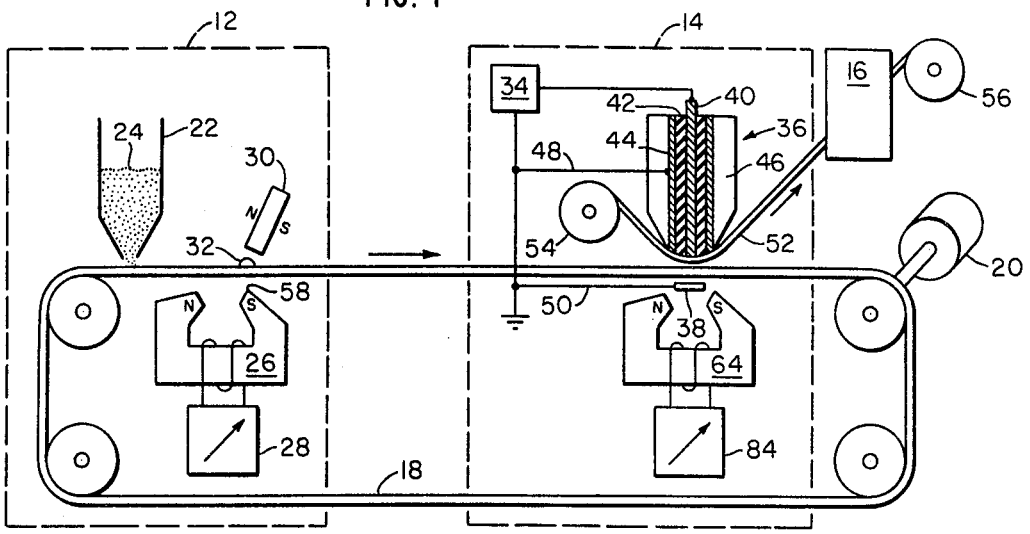
FIG. 1A
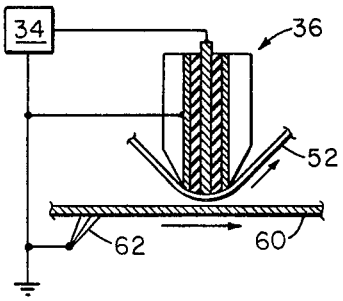
FIG. 2
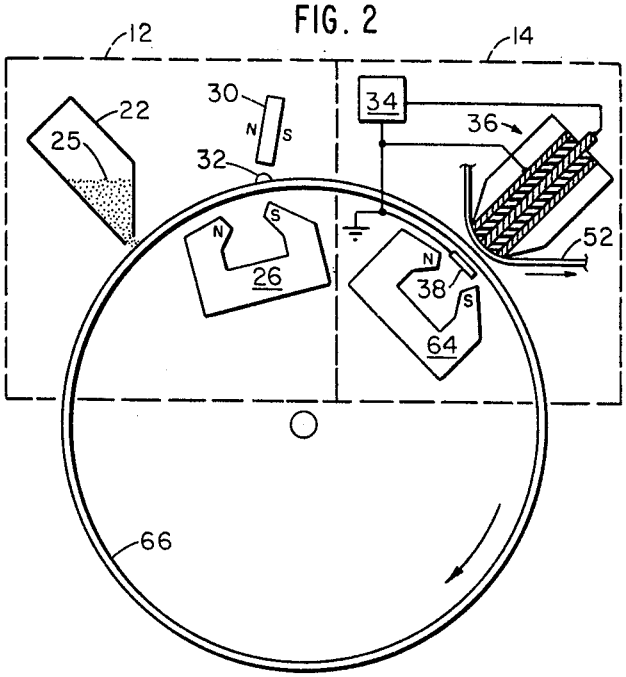
FIG. 2A
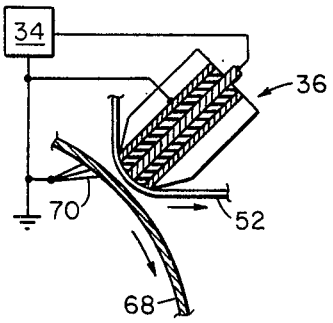
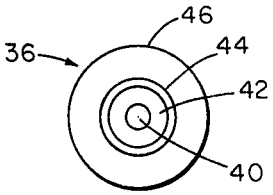
FIG. 3

FIG. 4
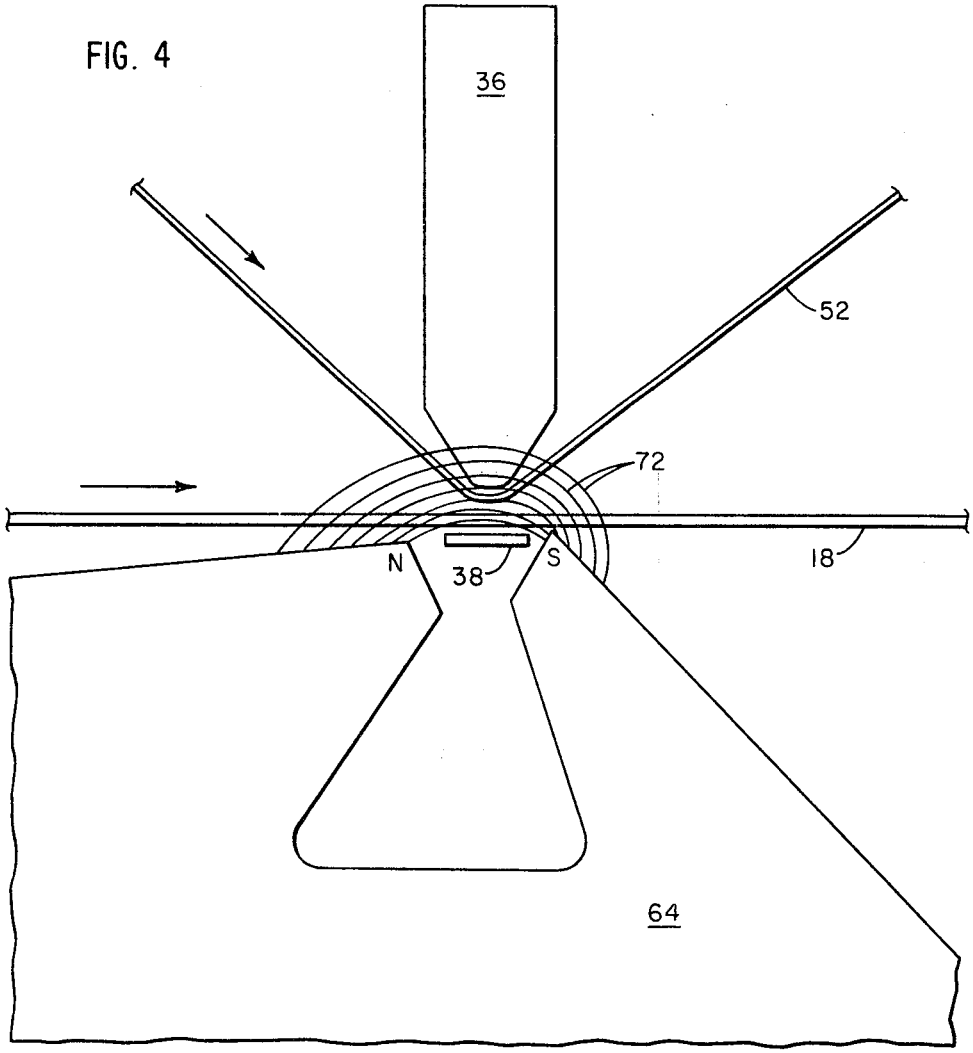
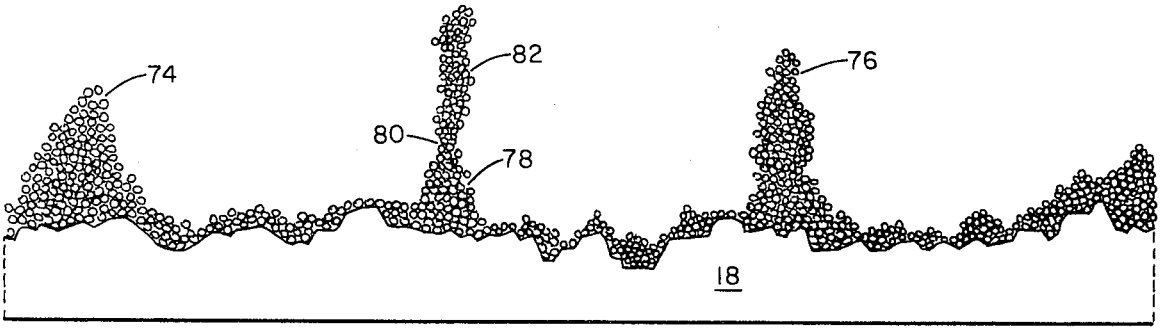
FIG. 5
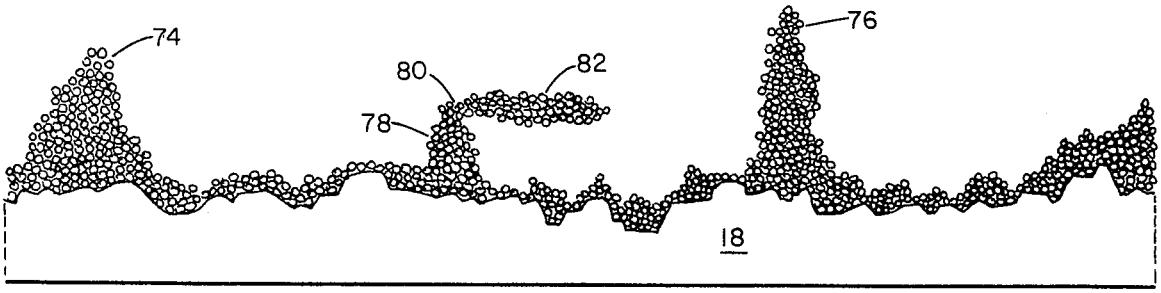
FIG. 6

NON-IMPACT PRINTER WITH MAGNETIC INK REORIENTATION

RELATED APPLICATIONS

This application has been assigned to the same assignee as copending applications Ser. No. 710,282 entitled, "Inks for Pulsed Electrical Printing and Methods of Producing Same", Ser. No. 710,280 entitled, "Magnetic Inking Apparatus for Pulsed Electrical Printing", and Ser. No. 710,283 "Structured Donor Sheet for High-Resolution Non-Impact Printer," all filed on even date herewith, and Ser. No. 710,292 entitled, "Pulsed Electrical Printer with Dielectrically Isolated Electrode", filed Aug. 2, 1976, and incorporates the disclosures thereof by reference as hereinafter specifically noted.

BRIEF SUMMARY OF THE INVENTION

This invention relates generally to apparatus for pulsed electrical printing, as contrasted to mechanical impact and electrostatic printers. Mechanical printers deliver ink to a recipient sheet by mechanical movement from a supply or donor sheet or strip. Electrostatic printers generally employ multi-step procedures involving sequential selective charging of surfaces and transfer of toner particles by electrostatic attraction. The present invention relates more directly to printers of the general type described in the U.S. Pat. to Robert W. Haeberle, et al. No. 3,550,153 dated Dec. 22, 1970. The printing process of said patent consists generally in providing an electrically conductive ink, a receiving or recipient paper or sheet, and a means for producing an electric field of a predetermined shape to be printed, in pulses between the ink and paper. In a typical application this field may be in the order of 1000 volts across a gap of between 5 and 10 mils, this gap being measured from the ink through the thickness of the receiving sheet to the pulsed field shaping electrode. The ink or pigment is in mobile, particulate form. During the brief presence of the electric field, the ink particles or pinnacles are first charged by conduction of current from other particles closer to a supporting sheet, detached by the electric field, and then caused to transfer to the receiving paper by the force induced solely by the electric field. As described in said patent, the particles of conductive ink are initially deposited upon a surface of an ink support described as a donor sheet. In general, the amplitude and duration of the electric pulses must be so related as to cause an efficient transfer of sufficient ink for the required printing density, without causing an electrical breakdown or discharge between the electrodes.

As described in said patent, the surface of the donor sheet closest to the recipient sheet includes electrically conductive particles of a printing material dispersed in a high resistance medium. The pulsed electrical field is applied to charge the printing particles selectively. The charged particles are subsequently transferred to the adjacent surface of the recipient sheet under the influence of the applied field. This is an efficient charging technique, whereby a charge is imparted to the printing particles in a very brief space of time. Because these conductive printing particles are dispersed in a high resistance medium, the electric field lines of the applied field become concentrated upon the conductive particles; thus these field lines tend to avoid the high resistance medium separating the conductive particles. The concentration of the field lines is a consequence of the concentration of induced charge upon these particles, and in addition it represents a focusing of lines of force upon the charged particles.

The force on a particle depends on the electric field strength at the particle and the charge on the particle, being proportional to the product of the charge and the field strength. Both factors are increased when charge accumulates on a conductive particle, since the gathering of the charge is accompanied by an increase in the density of field lines, which means an increase in the field strength, measured in lines per unit area.

In printers of the type described in said patent, there is a non-homogeneous distribution of conductive particles in a poorly conducting medium, particularly a depth distribution which leaves the particles in mounds or towers, and these particles will be subjected to strong forces tending to detach them from their neighbors and transfer them from the donor sheet to the recipient sheet. In the practice of the printing technique described in said patent, the high resistance medium need not be a solid material, and in some cases it can be air. That is, if the donor sheet is properly constructed and inked, in such a way that the conductive pigmented particles are arranged in mounds and towers, the air surrounding and separating these mounds and towers can play the role of the poorly conducting medium in which the conductive particles are dispersed.

A donor sheet for non-impact printing, in which the poorly conducting medium is a solid dielectric composite material, is described in U.S. Pat. No. 3,833,409 to John Peshin, dated Sept. 3, 1974. This donor sheet is described as having a high lateral resistivity to aid in confining the printing to the immediate vicinity of the printing electrode face.

A further improvement upon the printing apparatus of said U.S. Pat. No. 3,550,153 is described in U.S. Pat. No. 3,898,674 to Paul L. Koch dated Aug. 5, 1975. This patent describes a shield electrode that confines the printing field distribution more narrowly then would be possible with an unshielded printing electrode. It has been found that with the printing field distribution thus confined, satisfactory high resolution printing is obtained with a conductive base or support for the pigment particles, provided that the structure of the base or support and the arrangement of the pigment particles thereon are such as to produce a partial isolation of the conductive pigment particles into mounds and towers that are separated by a poorly conducting medium, such as air or a suitable solid material.

When the base material of the ink support is conductive, the hazard of electrical breakdown during the printing pulse is increased. This hazard can be reduced if the pulsed electrode is encapsulated within a dielectric material such as a glass or a plastic such as Kapton, a polyimide sold by E. I. duPont de Nemours & Co., which in either case will withstand, without breakdown, extremely high electric field strengths. As described in said application Ser. No. 710,892, entitled "Pulsed Electrical Printer with Dielectrically Isolated Electrode", the pulsed electrode can be recessed within the volume enclosed by a shield electrode, the remainder of this volume being filled by a dielectric material that can withstand without breakdown the high electric fields generated by the printing pulses.

Said application Ser. No. 710,280 entitled "Magnetic Inking Apparatus for Pulsed Electrical Printing" describes a magnetic inking process preferably using ink particles prepared as described in said application Ser. No. 710,282 entitled "Inks for Pulsed Electrical Printing and Methods of Producing Same". The latter application describes a process whereby conductive printing particles are prepared by incorporating iron oxide or other magnetizable material in each particle. In the magnetic inking station there is an arrangement of magnets that keeps a reservoir supply of magnetizable conductive printing particles in a compact strip or bead adjacent to the moving base layer, which may be a belt or a rotating drum. In either case the surface of the moving base layer or ink support is microcavernous, and because of the roughness of this surface there is friction between the surface of the support and the outside of the bead. The bead rotates as a result of this frictional force coacting with a magnetic field so distributed in the region of the bead that it restricts the location of the bead and gives it freedom to rotate within this restricted location.

At the same time, the combination of frictional and magnetic forces peels off enough particles from the rotating bead to leave the base layer covered by a coating of magnetizable conductive printing particles. This coating is largely in the form of mounds and towers, as a result of the orientation of the magnetic field lines in the region where the peeling-off process takes place. These lines are oriented steeply, with respect to this surface of the base layer, so that the magnetizable particles form into chains that stretch and break as the bead and the base layer pull apart. When the chains are stretched they are also made thinner and become laterally separated from each other. The broken fragments that remain attached to the surface of the moving base layer are consequently largely separated so as to form individual mounds and towers.

It often happens, however, that certain of the towers of magnetizable conductive printing particles are so long and tenuous that the printing pulse, when the base layer has moved from the inking station to the printing station, detaches these towers as whole strings of particles, rather than individually as one particle at a time. If this is the case, then the printing can have a speckled appearance, which is particularly undesirable if the printing is of the type known as facsimile with the capability of rendering a range of shades of grey as described in the U.S. Pat. to James C. Maxwell No. 3,964,388, dated June 22, 1976.

It is a principal object of this invention to reduce and minimize the speckling effect described above. It is a further and related object to provide improvements in the printing apparatus that will permit the printing of dark images having uniform fill, high edge definition, high resolution and strong contrast or print density.

According to this invention, means are provided to produce a strong magnetic field at the printing station. The lines of this field are oriented substantially parallel to the surface of the coated base layer or ink support as it moves through this station. By this means the longest and most tenuous of the towers of particles, being those most likely to print as speckles, will be bent over at their weaker points, so that their upper segments are turned substantially parallel to the strong magnetic field, hence substantially parallel to the surface of the base layer. Preferably, this turning action takes place just before the base layer reaches the center of the printing station. Thus the printing pulse will not be operative upon easily detached segments of particle chains that might print as speckles, but upon relatively stronger towers and mounds, from the summits of which the pulse will detach individual particles. As a consequence, the printing pulse will detach fewer chains that would transfer as clumps of particles, and the printed image will include fewer speckles and will have a more evenly printed appearance.

BRIEF DESCRIPTION OF THE DRAWINGS

FIG. 1 is a partially schematic drawing of a pulsed electrical printer embodying the invention, with a donor sheet in the form of an endless belt of high electrical resistance material.

FIG. 1A is a fragmentary drawing illustrating a variant of FIG. 1 employing an endless metallic belt.

FIG. 2 is a partially schematic drawing of a pulsed electrical printer embodying the invention, with a donor sheet in the form of a thin-walled rotating drum of high electrical resistance material.

FIG. 2A is a fragmentary view showing a variant of the embodiment of FIG. 2 employing a metallic rotating drum.

FIG. 3 is an end view of one form of print electrode used in each of the several illustrated embodiments.

FIG. 4 is a fragmentary enlarged view of the printing station showing the magnetic lines of force passing through the donor sheet in the vicinity of the print electrode.

FIG. 5 is a partially schematic view on a magnified scale showing a cross section of the donor sheet at a position between the inking station and the printing station.

FIG. 6 is a view similar to FIG. 5, showing a cross section of the donor sheet at a position directly opposite the print head.

DETAILED DESCRIPTION

FIG. 1 illustrates diagrammatically a pulsed electrical printer embodying the invention. The printer comprises a reinking station 12, a printing station 14, a fusing station 16, and other associated components as hereinafter described. An endless belt 18 of high electrical resistance material, having a roughened or microcavernous outer surface, is driven continuously by a drive motor 20. This belt and the other forms of ink support described herein are preferably constructed as described in said application Ser. No. 710,283 entitled "Structured Donor Sheet for High-Resolution Non-Impact Printer", the description of which is incorporated herein by reference. Also, other methods may be used in particular applications. In particular, base sheets having high lateral resistivity, for example, as described in said U.S. Pat. No. 3,833,409, and sheets of other forms having high resistance or insulating base structures as described in said U.S. Pat. No. 3,550,153, may be used. In any case, the surface of the ink support should have a roughened or microcavernous surface as hereinafter further described. A hopper 22 deposits particulate printing particles 24 upon the surface of the belt, which then travel past a lower magnet 26, which may be a permanent magnet or an electromagnet energized by a variable source 28. In certain embodiments, an overhead magnet 30 may also be employed. The printing particles contain magnetizable material and are preferably produced by the method described in said copending application Ser. No. 710,282 entitled "Inks for Pulsed Electrical Printing and Methods of Producing Same", the description of which is incorporated herein by reference. In the presence of the magnetic field, the printing particles deposited on the belt 18 form a rotating bead 32 from which a portion of the particles are peeled off and travel toward the printing station.

Details of the operation of the reinking station 12 are described in said application Ser. No. 710,280 entitled "Magnetic Inking Apparatus for Pulsed Electrical Printing", and are incorporated herein by reference. As the belt 18 leaves the reinking station 12, the magnetizable conductive printing particles thereon are ordinarily distributed in mounds and towers as shown in FIG. 5, but some of these towers will be long and tenuous, with one or more locations where the towers are unusually thin and weak. These locations are relatively easily broken under the force of the electrical printing pulse, so that prior to this invention, the particle chains above these locations would be detached by the pulse in some cases as whole chains rather than as individual particles detached one after another.

In the printing station, a source 34 of brief electrical pulses applies such pulses selectively between one or more print electrodes 36 and a base electrode 38. For simplicity, only a single print electrode 36 has been illustrated, whereas a practical printer is provided with a plurality of electrodes and means for selectively energizing them, as described in said U.S. Pat. Nos. 3,898,674 and in 3,733,613 to Paul L. Koch, et al. dated May 15, 1973. Also, it will be understood that although the illustrated print electrode is shaped for printing a round dot as used in facsimile and dot matrix alphanumeric printers, other shapes of electrodes may be employed. As shown in FIGS. 1 and 3, and in accordance with the teachings of said U.S. Pat. No. 3,898,674, the electrode 36 comprises a metallic field shaping electrode 40, and electrically insulating material 42, a metallic shield electrode 44 and a supporting body 46. By connections 48 and 50, the shield electrode and the base electrode are held at the same electrical potential.

By the action of brief electrical printing pulses between the field shaping electrode 40 and the base electrode 38, printing particles are transferred from the belt 18 to a web or sheet of ordinary untreated paper 52 passing from a supply roll 54 to a take-up roll 56. After the deposit of printing particles on the recipient paper 52, the latter passes through a fusing station 16 which provides sufficient heat to fuse the particles, thereby spreading them out and causing them to be more firmly attached to the paper. Details of the fusing step are given in said application Ser. No. 710,282 entitled "Inks for Pulsed Electrical Printing and Methods of Producing Same", and are incorporated herein by reference.

The rotating bead 32 is a loose aggregation of magnetizable conductive printing particles, these particles being preferably produced by the method described in said last-mentioned application. A portion of the contour of the bead is roughly cylindrical in shape, and in cross section it approximates a circle that is flattened on the side adjacent to the moving belt 18. The friction of the moving belt propels the lower surface of the bead toward the printing station 14, but the magnetic field distribution within the reinking station 12 is such as to oppose the forward motion of the magnetizable grains or particles in the bead, once these grains have moved a short distance past a corner 58 of the magnet 26 and have reached a region of weakened magnetic field. In some embodiments the lower magnet 26 is used alone, and in other embodiments the field may be produced by the magnet 26 in combination with the overhead magnet 30 as described in said application Ser. No. 710,280 entitled "Magnetic Inking Apparatus for Pulsed Electrical Printing". Instead of moving forward out of the strong field region, most of the grains in the lower part of the bead 32 will move upwardly away from the belt surface and participate in the rotational motion of the bulk of the grains in the bead. However, at the point where most of these grains turn and move upwardly, away from the surface of the belt, the orientation of the magnetic lines of force is such that the magnetizable grains will be aligned in small chains or threads running between the belt surface and the surface of the bead that is separating itself from the belt. Some of these chains or threads will elongate during the separation process, and will then break in two, leaving a portion of each broken chain on the surface of the belt, oriented upwardly from the belt surface.

FIG. 1A illustrates a variant of the embodiment of FIG. 1, in which the belt 18 is replaced by an endless belt 60 made of metal or other conductive material having a roughened or microcavernous surface. In this case a brush 62 or other equivalent means is connected with the source 34, whereby the belt 60 itself functions as a base electrode, thereby replacing the function of the electrode 38 in FIG. 1.

In the embodiments of FIGS. 1 and 1A, the printing station 14 is provided with a magnet 64 that is operable to reorient some of the mounds and towers of printing particles. More specifically, the field produced by this magnet is operable at the locations of weakness in the particle chains mentioned above and illustrated in FIG. 5, whereby the upper segments of certain of the towers can be bent over. More particularly, the magnetic field is designed to turn the upper segments of the weaker towers until they are substantially parallel to the base layer, and substantially perpendicular to the direction of the applied electric field generated by the printing pulse as illustrated in FIG. 6. The bent-over segments are then no longer strong focal points on which the electric lines of force will gather, and there will be less charge drawn to the segments. The number of such segments that are detached and printed will be greatly reduced, and the printed regions will accordingly be less speckled in appearance.

Thus the magnet 64 generates a strong magnetic field distribution whose magnetic lines of force in the vicinity of the print head 36 are substantially parallel to the average surface of the donor sheet or belt 18 where it passes closely opposite to the printing electrode 36. Ordinarily, the magnet 64 may be a simple horseshoe magnet located on the opposite side of the belt 18 from the print head 36.

The magnet 64 occupies a position in close proximity to the base electrode 38. In certain cases it may be mechanically convenient to combine the base electrode with the magnet structure, forming a composite structure that provides a magnetic ground plane, that is, an electrically grounded surface with associated magnetic field lines that are substantially parallel to the surface in a central region located directly opposite to the print head 36.

In the embodiment of FIG. 2, many of the elements are the same as those illustrated in FIG. 1. However, a thin-walled rotating drum 66 of high electrical resistance material serves as the donor sheet or support for the printing ink particles, replacing the moving belt 18. The outer surface of the drum 66 is microcavernous, providing sufficient frictional force to maintain the rotational movement within the bead 32. The inking station 12 contains, as in FIG. 1, the lower magnet 26 and the overhead magnet 30, establishing a magnetic potential well that restricts the forward motion of the bead 32. The inking station 12 also contains the hopper 22 with its reservoir of ink or pigment particles 25 by which the supply of particles in the bead 32 is replenished. The embodiment of FIG. 2 also includes the magnet 64, the function of which is the same as in FIG. 1.

The embodiment of FIGS. 2A is similar to the embodiment of FIG. 2, except that the drum 66 is replaced by a drum 58 of metal or other electrically conductive material, and a brush 70 is connected to the source 34, whereby the drum 68 replaces the function of the base electrode 38.

In the embodiments of FIGS. 2 and 2A, the rotating bead 32 acts to meter and distribute the magnetizable conducting printing particles over the outer surface of the rotating drum 66 or 68. The drum carries its inked surface around to the printing station 14. The printing station contains the print head or electrode 36. The receiving web or recipient sheet 52 passes between the print head and the ink surface of the rotating drum. Means similar to elements of FIG. 1 move the receiving web 52 from a supply roll to a take-up roll through a fusing station.

FIG. 4 is an enlarged view showing the ground electrode 38 and the ground-plane magnet 64. Also shown are some of the magnetic lines of force 72 generated by the magnet 64. The approximate locations of the print head 36 and the recipient web 52 are also shown. It is evident that the donor sheet, represented by the moving belt 18, will move from left to right in the direction of the arrow through regions in which the magnetic lines change in their directions, from steeply upward to slightly upward, to horizontal, to slightly downward and then to steeply downward. The printing takes place from a portion of the donor sheet where the magnetic lines are approximately horizontal, parallel to the surface of the donor sheet or belt 18 and accordingly perpendicular to the direction of the electric field vector between the print electrode 36 and the ground electrode 38.

FIG. 5 is a highly magnified representation of the donor sheet or belt 18 at a position between the magnetic inking station 12 and the printing station 14. There is shown a mound 74 and a tower 76 of magnetizable conductive printing particles. Also shown is a more tenuous tower that has a sturdy lower section 78, a thin point 80, and an upper segment 82. This upper segment would ordinarily be readily detached by a printing pulse, and would thereafter be accelerated by this pulse and transported as a clump of ink particles, which would print as a speckle. This detachment of the upper segment 82 would occur if the particle configuration shown in FIG. 5 were to enter without change into the region opposite to the print head 36, and to be subjected there to the electric field generated by the printing pulse.

However, with the ground-plane magnet 64 present as shown in FIGS. 1 and 2, the particle configuration of FIG. 5 is modified as it approaches the print head. As the particle configuration of FIG. 5 enters part-way into the magnetic field, at the left extremities of the lines 72 as viewed in FIG. 4, these lines are tilted forwardly with reference to the direction of travel of the belt. Therefore, the upper segment 82 of the tenuous tower with the sturdy lower section 78 will attempt to align itself with the changing direction of the magnetic field lines. Because of the weakness of the thin point 80, the upper segment 82 will bend over.

In FIG. 6, this same portion of the donor sheet or belt is shown in cross-section, after it has moved to a position directly opposite to the printing electrode 36. Here the magnetic lines of force are substantially parallel to the ground electrode and to the averaged surface of the donor sheet. The upper segment 82 of the tenuous tower with the sturdy lower section 78 will here be aligned roughly parallel to the magnetic field lines, hence roughly parallel to the averaged surface of the donor sheet, and roughly perpendicular to the electric field lines that are generated by the printing pulse. The topmost part of this tenuous tower will also have been lowered by the magnetic bending action, as is evident by comparing FIGS. 5 and 6.

As a consequence of the magnetic reorientation of the ink particles, the electric lines of force associated with the printing pulse will accordingly concentrate more strongly upon the competing mound 74 and tower 76, leaving the bent-over segment 82 only weakly charged and hence much less likely to be detached and printed by the applied electrical pulse.

The magnetic field strength close to the printing electrode is chosen to be sufficient to bend over those towers of magnetizable conductive printing particles that are so long and tenuous that whole segments, containing many particles, are liable to be detached as clumps of particles during the printing pulse and to print as speckles whose size is too large to be considered acceptable. At the same time, the magnetic field strength close to the printing electrode is chosen to be smaller than that which would bend over the stronger towers whose presence is needed for the efficient operation of the printing mechanism. In a typical application, the field strength close to the printing electrode is in the range between 1000 and 2000 oersteds.

In cases where the characteristics of the printing particles are subject to variability from time to time, the strength of the magnetic field generated by the magnet 64 is preferably adjusted empirically. For this purpose a variable source 84 is connected with the magnet as shown in FIG. 1. Thus the magnetic field strength is increased to a magnitude sufficient to reduce substantially the number of clumps of particles that are detached by the printing pulse and printed as speckles of objectionably large size. Some reduction in print intensity will accompany this reduction in speckling, but this intensity reduction can ordinarily be matched by a compensating intensity increase, obtained by an increase in the voltage of the printing pulses, or the duration of these pulses, or both.

It will be understood that while the term printing pulse may refer to a single unipolar pulse, which may be square or rounded in waveform, an acceptable printed image can also be obtained through the use of a printing wave form that is bipolar, and a sequence of bipolar pulses comprising a plurality of such pulses can be used for printing a single image. Accordingly, the above-mentioned compensating intensity increase can also be obtained by an increase in the number of single pulses in the bipolar sequence of pulses of alternating polarity that constitute a printing waveform.

I claim:

1. Printing means comprising, in combination, a print electrode having a shaped portion for printing, an ink source comprising a support with a surface facing said shaped portion, a quantity of ink particles loosely distributed on said surface in mutually spaced aggregates of irregular height, the particles comprising a magnetic material, and means to move the support to cause said surface to pass through a print position in predetermined spaced relation to said shaped portion, means to move an ink recipient sheet past the print position between said shaped portion and said surface, means to cause an electrical field of short duration to extend between said shaped portion and the support at the print position, and means to cause a magnetic field to pass through the aggregates approaching the print position, said magnetic field being fixed in relation to the print position, having a substantial component perpendicular to the direction of the electrical field at said print position, and being of sufficient strength to reorient a number of said aggregates.

2. Printing means according to claim 1, in which the support is an elongate sheet.

3. Printing means according to claim 2, in which said elongate sheet is conductive and the means to cause an electrical field are connected between the print electrode and said elongate sheet.

4. Printing means according to claim 2, in which the means to cause an electrical field include a second electrode, the elongate and ink recipient sheets passing between the print and second electrodes.

5. Printing means according to claim 1, in which the support is an endless flexible belt and the ink source has means to deposit ink particles on the belt.

6. Printing means according to claim 1, in which the support is a drum.

7. Printing means according to claim 6, in which the drum is conductive and the means to cause an electrical field are connected between the print electrode and the drum.

8. Printing means according to claim 6, in which the drum is hollow and the means to cause an electrical field include a second electrode located within the drum.

9. Printing means according to claim 1, in which the means to cause a magnetic field comprise a magnet situated on the side of the support opposite to said surface.

10. Printing means according to claim 9, in which the magnet is horseshoe shaped with its poles in position to produce a field in the print position.

11. Printing means according to claim 1, in which a portion of the magnetic field in the region of the print position is in the range between 1000 and 2000 oersteds.

12. Printing means according to claim 1, in which the electrical field is a monopolar pulse.

13. Printing means according to claim 1, in which the electrical field comprises at least two pulses of opposite polarity.

14. Printing means according to claim 1, with means to vary the relative strengths of the magnetic and electrical fields to cause selective reorientation of higher aggregates at a predetermined print density.

15. Printing means according to claim 1, with a shield electrode insulated from and substantially surrounding the shaped portion of the print electrode, and means to maintain the shield electrode at an electrical potential different from that of the print electrode.

16. Printing means according to claim 15, in which the support is conductive.

17. Printing means according to claim 1, with means to vary the strength of the magnetic field.

* * * * *

UNITED STATES PATENT AND TRADEMARK OFFICE

CERTIFICATE OF CORRECTION

PATENT NO. : 4,103,306

DATED : July 25, 1978

INVENTOR(S) : Roger E. Clapp

It is certified that error appears in the above-identified patent and that said Letters Patent are hereby corrected as shown below:

Column 1, line 13, cancel "710,292" and substitute --710,892--.

Column 2, line 40, cancel "then" and substitute --than--.

Signed and Sealed this

Sixth Day of March 1979

[SEAL]

*Attest:*

RUTH C. MASON
*Attesting Officer*

DONALD W. BANNER
*Commissioner of Patents and Trademarks*